United States Patent [19]

Rumble et al.

[11] Patent Number: 4,860,908

[45] Date of Patent: Aug. 29, 1989

[54] CRUSHABLE CONTAINER AND METHOD FOR WEAKENING THE CONTAINER

[76] Inventors: Richard R. Rumble, 11 Parkway Ct., Orinda, Calif. 94563;

[21] Appl. No.: 742,169

[22] Filed: Jun. 6, 1985

[51] Int. Cl.[4] ..... B65D 1/40

[52] U.S. Cl. ..... 220/1 R; 215/1 C

[58] Field of Search ..... 220/1 R, 1 B, 1 C; 215/1 C; 150/0.5

[56] References Cited

U.S. PATENT DOCUMENTS

| | | | |
|---|---|---|---|
| 2,139,143 | 12/1938 | Wiswell | 220/1 BC X |
| 2,522,408 | 9/1950 | Sowter . | |
| 2,792,145 | 5/1957 | Sowter . | |
| 3,367,380 | 2/1968 | Dickey . | |
| 3,850,338 | 11/1974 | Hatada . | |
| 3,872,994 | 3/1975 | Hyde | 215/1 C X |
| 3,918,603 | 11/1975 | Hatada . | |
| 4,322,013 | 3/1982 | Tanaka . | |
| 4,324,340 | 4/1982 | Belokin, Jr. | 215/1 C X |

FOREIGN PATENT DOCUMENTS

| | | | |
|---|---|---|---|
| 0097399 | 1/1984 | European Pat. Off. | 220/1 BC |
| WO83/02602 | 8/1983 | PCT Int'l Appl. . | |

*Primary Examiner*—Steven M. Pollard

*Attorney, Agent, or Firm*—Townsend and Townsend

[57] ABSTRACT

A cylindrical metal container is weakened along folding regions to aid crushing by hand or when using a can crusher. The weakened folding regions are created by nondeformably weakening the material strength of the container along the folding regions. This is typically accomplished by quickly heating and then cooling the container along the folding regions to anneal the material in the folding regions so the material strength of the folding regions is less than that of the surrounding container material. One direct heating method uses an open flame to rapidly heat the container material. Heated rollers can also be used to heat the folding regions indirectly. Other methods for the localized weakening of the material strength, such as chemical etching, can also be used. The pattern of the folding regions is determined by the configuration of the container and the expected method of crushing. A preferred pattern has weakened folding regions as circumferential band adjacent the top and bottom of a cylindrical container.

17 Claims, 1 Drawing Sheet

CRUSHABLE CONTAINER AND METHOD FOR WEAKENING THE CONTAINER

BACKGROUND OF THE INVENTION

One of the problems with metal beverage cans, since they are used in great numbers, is that once empty they create great volumes of trash. Although many people know that it is advisable to recycle aluminum cans, the usual excuse for not going so is that the empty cans take up too much room. To reduce this bulk, many types of mechanical can crushers have been developed. Although can crushers may work, they are not an ideal solution for many people. Can crushers become one more thing cluttering up the house, their existence based upon the often weak desire of the owner to make big cans into little cans.

Recognizing this, several systems have been developed to allow people to crush beverage cans by hand. See for example, U.S. Pat. Nos. 3,850,338 and 3,918,603 to Hatada and 4,322,013 to Tanaka and PCT Application WO 83/02602. These references all disclose the use of grooves or creases in the can, along what can be considered fold lines, to allow the cans to be crushed by hand.

SUMMARY OF THE INVENTION

The present invention is directed to a crushable container and method for weakening the container by which the container is weakened along folding bands or regions without deforming the container. Thus, the additional metal working step to create creases or grooves required with the prior art crushable cans is not required.

A metal container, such as a cylindrical beverage can, is weakened along folding bands or regions to aid crushing by hand. The weakened folding regions are created by weakening the material strength of the container. This is typically accomplished by nondeformably weakening the material strength in the folding regions. A preferred way of doing so is by heating chosen regions of the container so that the material strength in these regions is less than the strength of the surrounding container material. Heat can be applied directly, such as by using a direct flame, or indirectly, such as by using a heated roller element which presses against the can. Other means for the localized heating of the can, including induction heating and laser heating, may be suitable for use as well.

The weakened folding regions need not be continuous but may be interrupted in a perforated fashion or may be a series of closely spaced, relatively narrow weakened lines or bands. The pattern of the folding region is determined by the configuration of the container and the expected method of crushing.

A primary aspect of the present invention is the recognition and appreciation that cold working of metal typically strengthens the metal; a cold worked metal can is therefore stronger than the stock from which it was made. Applicant's invention takes advantage of this fact by weakening the material strength, typically by annealing, along bands or regions of the metal container where the greatest amount of deformation will take place. The heating step of the annealing process can be by the use of a variety of sources of heat including flame, laser and induction. When using lasers, which is a very quick acting, localized source of heat, lines or bands forming the weakened folding regions having accurate, uniform widths can be created. With the nondeformably weakening aspect of the present invention, the expensive extra mechanical step required to groove or crease the metal may be eliminated. By accurately controlling the placement and widths of the weakened folding regions, the overall strength of the container need not be impermissibly lessened.

Another key aspect of the invention is the recognition that when many containers, such as cylinders with tops and bottoms, are crushed, crumpling of the container necessarily occurs. This crumpling creates multiple creases or folds in the container which can increase the force required to crush the container. Further, it has been recognized that the top and bottom of a cylindrical container greatly strengthens the cylindrical container wall at those regions. In light of these observations, folding regions in one embodiment are created as bands adjacent the top and the bottom of a cylindrical beverage can. The relatively wide folding regions weaken the container at the places most in need of being weakened and thus accommodate the crumpling which necessarily occurs when the cylindrical container is flattened using one of several deformation schemes.

Prior art crushable containers often use grooves or creases, which are intended to act as hinges or fold lines so that when a crushing force is applied, the can, instead of crumpling randomly, which can hinder complete crushing, crushes in a more controlled manner by, initially at least, bending along the deformed region. The present invention recognizes that the provision of grooves or creases in a metal can be deforming the can along certain fold lines can increase, rather than decrease, the strength of the can in those places. With the present invention the fold lines are replaced by folding regions created, preferably in a nonmechanical way, by the localized weakening of the material strength of the container. Although various ways may be used to do so, including applying bands of etching chemicals to roughen the surface along the fold lines or reducing the material strength by modifying the molecular structure, accurate localized annealing is thought to be the most promising. Mechanical methods for decreasing the material strength of the can, such as rolling or otherwise making the material thinner in the folding regions compared with the surrounding areas, may also be used alone or in conjunction with nonmechanical localized weakening of the material strength.

Other features and advantages of the present invention will appear from the following description in which the preferred embodiments have been set forth in detail in conjunction with the accompanying drawings.

BRIEF DESCRIPTION OF THE DRAWINGS

FIGS. 3B and 3C show the container of FIG. 2A completely crushed with the ends folded in different directions.

DETAILED DESCRIPTION OF THE PREFERRED EMBODIMENTS

Figure 1:
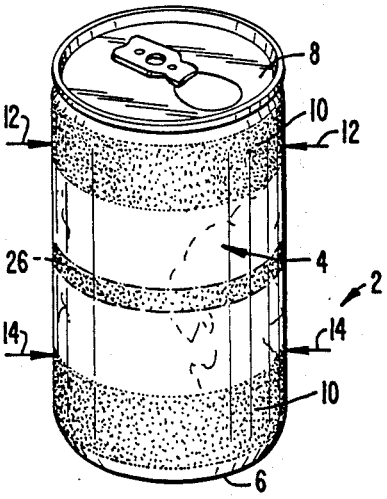
FIG. 1 is an isometric view of a first beverage container embodiment made according to the present invention.
Figure 2:
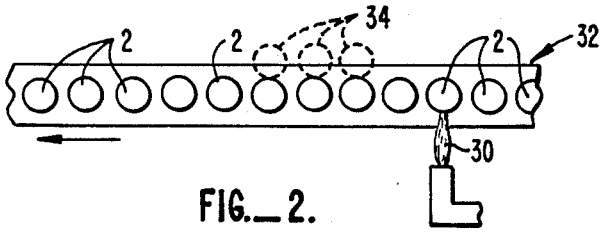
FIG. 2 schematically illustrates applying heat to the passing containers.
Figure 5:
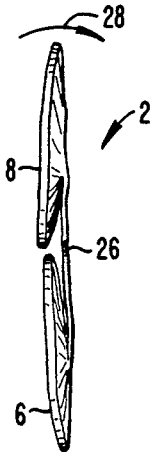

Referring now to FIGS. 1 and 2, a metal, typically steel or aluminum, beverage container 2 includes a cylindrical body 4, having an integral bottom 6 and a separately applied top 8. Circular weakened folding line regions or bands 10 are formed about cylindrical body 4 to aid the manual crushing of container 2.

Weakened folding line regions 10 are formed by directing a flame 30 at container 2 while moving along a production line 32. The size and temperature of flame 30 and the speed at which containers 2 move along production line 32, which determine the speed the flame traverses the surface of cylindrical body 4, are adjusted to create the proper amount of localized heating of container 2. This localized heating and subsequent air cooling of weakened folding regions 10 anneals the folding regions to lower their strength relative to the surrounding regions of the container not subjected to the localized heating. It has been found that making the width of weakened folding regions 10 about one-half the diameter of container 2 is sufficient for conventional aluminum and steel beverage containers crushed in the manners discussed below. Other sources of heat, such as heated rollers 34 against which containers 2 roll as they pass along line 32, can be used instead of or in addition to flame 30.

Cans, such as container 2, are often made by a drawing process. In such cases, weakened folding line regions 10 for these drawn containers will be created only after cylindrical body 4 and bottom 6 have been formed. Container 2 may also be made from a rectangular sheet of metal rolled into a cylinder and sealed along a seam with a top and a bottom mounted to the ends. In this case, it may be desired to create weakened folding regions 10 before the strip of material is formed into the cylindrical body.

Figure 3A:
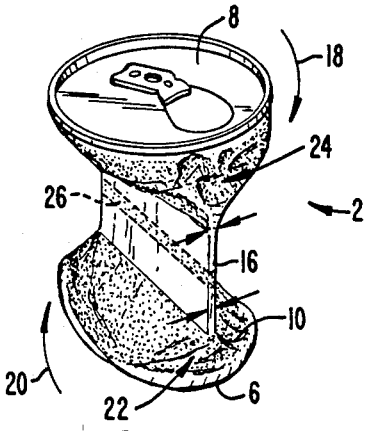
FIG. 3A shows the container of FIG. 1 being crushed.
Figure 3B:
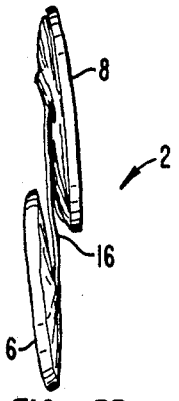

Container 2 can be crushed in several ways. One way, shown in FIGS. 3A and 3B, is to collapse the sides toward one another by first pressing on body 4 at arrows 12, 14 to create a deformed flattened body region 16. Next top 8 is rotated in direction of arrow 18 and bottom 6 is rotated in the direction of arrow 20 to create the flattened can structure of FIG. 3B. Note that crumpled areas 22, 24 are within weakened folding regions 10. Also note that bands 10 extend into the necked-down region adjacent top 8 and bottom 6 and not just along the cylindrical portion of container 2. If desired, and depending on the shape of container 2, bottom 6 can be rotated in the direction opposite arrow 20 so that both bottom 6 and top 8 lie on the same side of body region 16. The result of such flattening technique is shown in FIG. 3C. An optional folding region 26 may be provided about the central portion of container 2 so that after the container is in the configuration of FIG. 2C, top 8 can be folded about region 26 in the direction of arrow 28.

Figure 4A:
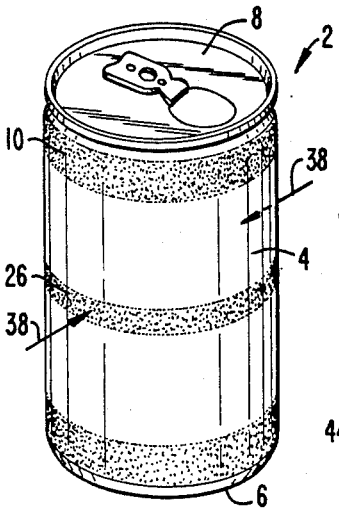
FIGS. 4A–4C illustrate a second crushing sequence for the container of FIG. 1.
Figure 4B:
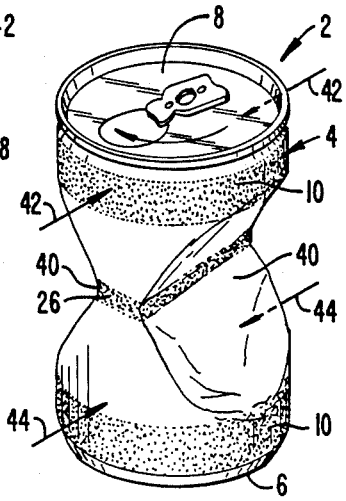
Figure 4C:
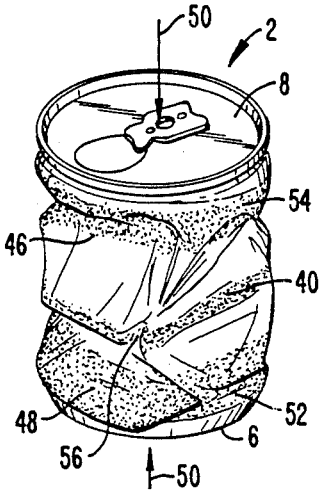

FIGS. 4A–4C show another method for collapsing container 2. First container 2 is partially crushed along arrows 38 to create the preliminary indentations 40 shown in FIG. 4B. Next container 2 is partially crushed in the direction of arrows 42 adjacent top 8 and then in the direction of arrows 44 adjacent bottom 6 to create indentations 46, 48. Container 2 is then compressed axially in the direction of arrows 50. FIG. 4C shows container 2 during the initial portion of the final, axial crushing step. When fully compressed container 2 is about one-half the height shown in FIG. 4C. As with the crushing method of FIGS. 3A–3C, the crumpled areas 52, 54, 56 are located in weakened folding regions 10 and optional folding region 26 to aid collapse of container 2.

Modification and variation can be made to the disclosed embodiments without departing from the subject of the invention as defined by the following claims.

I claim:

1. A method for weakening a metal container comprising the following steps:

selecting a pattern of folding regions according to the configuration of the metal container and the mode of crushing to be used; and nondeformably weakening the material strength of the container along the folding regions to promote crushing of the container.

2. A cylindrical metal can made by the process of claim 1.

3. The method of claim 1 wherein the weakening step is carried out by heating the container along the folding regions.

4. The method of claim 3 wherein the heating is carried out using a flame.

5. The method of claim 3 wherein the heating is carried out using a heated object in physical contact with the container.

6. A cylindrical aluminum can made by the process of claim 5.

7. A cylindrical metal can made by the process of claim 5.

8. A method for weakening a cold worked, cylindrical metal container having a cylindrical body, a top and bottom, comprising the following step:

nondeformably weakening the cylindrical body along first and second annular folding regions adjacent the top and the bottom to promote crushing of the container.

9. The method of claim 8 wherein the weakening step includes the step of heating and cooling the cylindrical body in the first and second folding regions to anneal the cylindrical body at the first and second folding regions.

10. The method of claim 8 wherein the annular folding regions have widths equal to approximately one-half the container diameter.

11. A metal can comprising:

a cylindrical metal body;

a top;

a bottom; and said body having folding regions in which the material strength of the metal body is less than the surrounding metal body regions to promote crushing of the can, said folding regions being undeformed relative to surrounding metal body regions.

12. The metal can of claim 11 wherein the metal body is an aluminum body.

13. The metal can of claim 11 wherein the folding regions are annealed regions created by localized heating of the metal body.

14. The metal can of claim 13 wherein the heating is accomplished using flame.

15. The metal can of claim 11 wherein the folding regions are bands circumscribing the cylindrical metal body adjacent the top and the bottom.

16. The metal can of claim 15 wherein the folding regions have widths equal to approximately one-half the body diameter.

17. A container crushing method comprising the following steps:

providing a cylindrical container having a top, a bottom and annular weakened folding regions adjacent the top and bottom with widths equal to about one-half the container diameter;

radially squeezing the container along a first line of action at midway positions on opposite sides of the container to create first and second indentations;

radially squeezing the container along second and third lines of action between the midway positions and the top and the bottom, the second and third lines of action being parallel to each other and generally perpendicular to the first line of action; and axially compressing the container along an axial line of action passing through the top and bottom to force the top and bottom together.

* * * * *